United States Patent [19]

Entrekin

[11] Patent Number: 4,597,266

[45] Date of Patent: Jul. 1, 1986

[54] FREEZING AGENT AND CONTAINER

[75] Inventor: Stephen Entrekin, Birmingham, Ala.

[73] Assignee: CryoLife, Inc., Sarasota, Fla.

[21] Appl. No.: 737,680

[22] Filed: May 28, 1985

[51] Int. Cl.[4] ..... F17C 7/00

[52] U.S. Cl. ..... 62/46; 62/47; 62/48; 62/384; 62/457; 252/67; 252/71

[58] Field of Search ..... 62/384, 48, 47, 46, 62/1, 457, 514 R; 252/67, 71

[56] References Cited

U.S. PATENT DOCUMENTS

| | | | |
|---|---|---|---|
| 3,065,606 | 11/1962 | Reynolds | 62/1 |
| 3,393,152 | 7/1968 | Smith et al. | 62/384 |
| 3,406,532 | 10/1968 | Rownd et al. | 62/457 |

*Primary Examiner*—Ronald C. Capossela
*Attorney, Agent, or Firm*—Jones & Askew

[57] ABSTRACT

A freezing agent for maintaining supercold temperatures. Solid carbon dioxide is impregnated with liquid nitrogen so that the liquid nitrogen diffuses through the lattice of crystals making up the solid carbon dioxide. The liquid nitrogen maintains the solid carbon dioxide at supercold temperature for a long period of time. The nitrogen-impregnated solid carbon dioxide can be in the form of nuggets for lining or packing a cooling container, and a frozen biological sample can be maintained at supercold temperature within the container for many hours.

4 Claims, 1 Drawing Figure

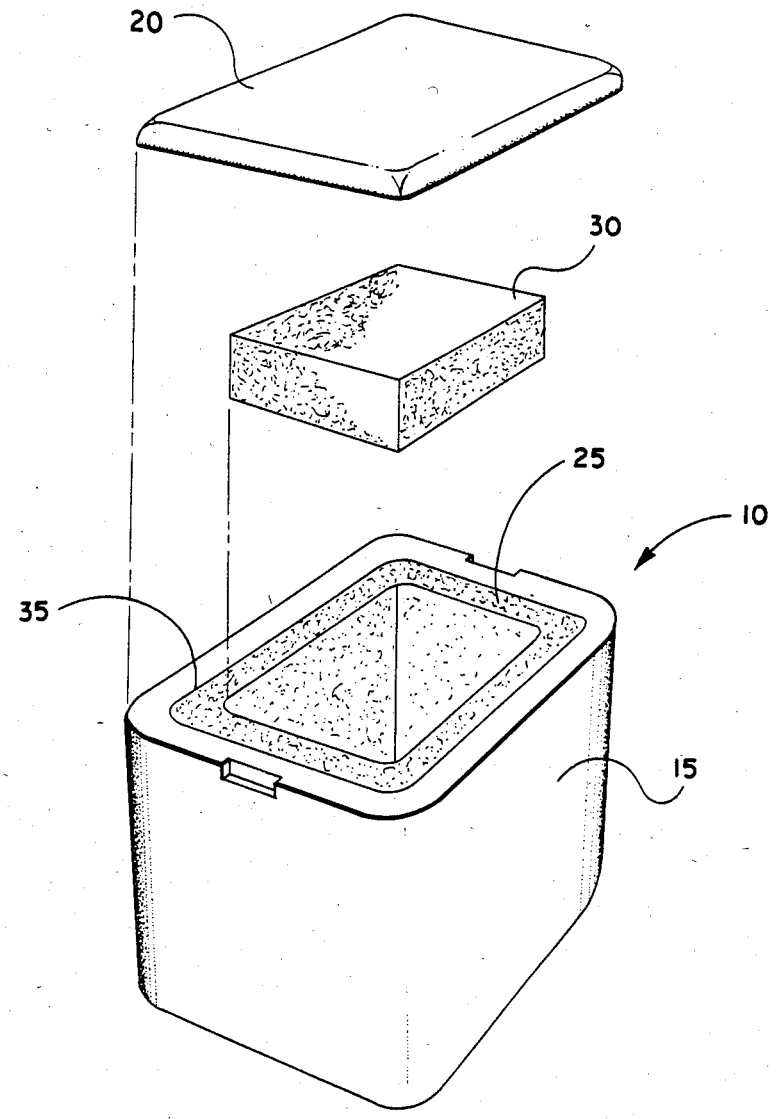
20
30
25
10
35
15

FREEZING AGENT AND CONTAINER

TECHNICAL FIELD

The present invention relates to a freezing agent and container for transporting and storing frozen materials and more particularly to a freezing agent and container for transporting and storing materials at supercold temperatures.

BACKGROUND OF THE INVENTION

Biological specimens such as tissues and organs that are to be used in transplantation must often be transported over large distances from the donor to the recipient. Currently, most of these tissues and organs are cooled to just above 0° C. and are transported by packing the tissues in ice. When tissues are shipped in this manner, the viability of the tissue can be maintained at an acceptable level only for a short period of time. If the tissues are not used within several hours after removal from the donor, the tissue will begin to deteriorate and will no longer be usable as a transparent tissue or organ.

Another method of preparing tissues for transport is by first freezing the tissue and then lowering the temperature of the tissue to super cold temperatures lower than −190° C. This is commonly done for heart valves. Freezing transplanation tissues offers many advantages over cooling tissues to near 0° C. The tissues can be tested for compatability andd then stored in supercold refrigerators in tissue banks until they are needed. In this way, a tissue is immediately available when it is needed. However, the frozen tissue must still be transported as rapidly as possible since the recipient may only have a limited amount of time within which the tissue can be transplanted.

Rapidly transporting tissues at supercold temperatures presents certain problems. The most common method of maintaining supercold temperatures is through the use of liquid nitrogen. The boiling point of nitrogen is −195.8° C. In addition, nitrogen is nontoxic. However, as nitrogen warms, it is transformed into a gas and escapes into the atmosphere. Thus, conventional methods of transporting tissues at supercold temperatures utilize specially constructed bottles that are well insulated. However, because these bottles are sealed there is a danger that the nitrogen will warm up and will transform into a gas. If the container is sealed, there is great danger of an explosion. As a result of this danger, transportation of liquid nitrogen is highly regulated. In fact, transportation of liquid nitrogen-containing vessels on commercial airlines is prohibited in some countries.

Thus, frozen tissues and organs that must be maintained in a frozen state in liquid nitrogen must be shipped by special carrier. This increases the time and cost of shipping these types of biological specimens.

SUMMARY OF THE INVENTION

The freezing agent of the present invention comprises solid carbon dioxide that has been impregnated with liquid nitrogen. The nitrogen-impregnated solid carbon dioxide has been found to maintain a frozen sample at a temperature below −160° C. for more than eighteen hours without the use of a specialized container. Thus, in accordance with the present invention, a new freezing agent is provided with which one can safely transport or store biological tissues at supercold temperatures.

Since the freezing agent of the present invention is a solid, there is no danger of spillage and there is no need to provide a container capable of holding liquids. The solid freezing agent can be shaped like granules or nuggets which readily are packed around the sample to be shipped. The sample and freezing agent can then be placed into a suitable cryogenic container. As the nitrogen that is impregnated in the solid carbon dioxide evaporates, the nitrogen is released harmlessly into the surrounding atmosphere. There is no danger of explosion since the freezing agent of the present invention is not packed in an air tight container.

Thus, it is an object of the present invention to provide an improved freezing agent for storing and shipping samples at supercold temperatures.

It is another object of the present invention to provide a freezing agent and container for storing and shipping samples at supercold temperatures without the necessity of a specialized container.

It is another object of the present invention to provide a freezing agent and container for storing and shipping samples at supercold temperatures that will hold the sample at the desired temperature for a period of time sufficient to allow the sample to reach the desired destination.

It is a further object of the present invention to provide a freezing agent and container for storing and shipping samples at supercold temperatures safely and inexpensively.

It is yet another object of the present invention to provide a solid freezing agent that will sublime as it warms up and will not pass through a liquid phase.

These and other objects, features and advantages of the present invention will become apparent after a review of the following detailed description of the preferred embodiment and the appended claims.

BRIEF DESCRIPTION OF THE DRAWING

The FIGURE is an exploded perspective view of the freezing container according to a disclosed embodiment of the present invention.

DETAILED DESCRIPTION OF THE PREFERRED EMBODIMENT

The present invention comprises solid carbon dioxide that is impregnated with liquid nitrogen. Solid carbon dioxide is comprised of a lattic of carbon dioxide crystals. In accordance with the present invention, the solid carbon dioxide is immersed in liquid nitrogen for a time sufficient to allow the liquid nitrogen to diffuse throughout the solid carbon dioxide. The amount of time that is required for the liquid nitrogen to diffuse throughout the solid carbon dioxide is proportional to the size and surface area of the solid carbon dioxide. For example, a one pound quantity of solid carbon dioxide nuggets must be immersed in the liquid nitrogen for approximately twelve hours for complete saturation of the solid carbon dioxide with nitrogen. By saturating the solid carbon dioxide with liquid nitrogen, the temperature of the solid carbon dioxide is lowered from approximately −70° C. to approximately −190° C.

Because the liquid nitrogen is trapped within the carbon dioxide lattice, the liquid nitrogen unexpectedly maintains the carbon dioxide at a supercold temperature for a long period of time. As the supercold nitrogen-impregnated carbon dioxide warms up, the carbon dioxide and the nitrogen both sublime into a gas phase and thereby diffuse harmlessly into the atmosphere.

The nitrogen-impregnated carbon dioxide nuggets can be used to maintain an enclosed frozen object in the frozen state. For example, the nitrogen-impregnated carbon dioxide nuggets can be placed in styrofoam cryoshipping container. A frozen biological sample can then be placed inside the container, surrounded by a quantity of such nuggets, and can be maintained at a supercold temperature for many hours.

EXAMPLE I

A one pound quantity of solid carbon dioxide nuggets is immersed in three pounds of liquid nitrogen. The quantity of carbon dioxide was allowed to remain immersed in the liquid nitrogen for twelve hours. The carbon dioxide nuggets are then removed from the liquid nitrogen. The temperature of the nitrogen-impregnated carbon dioxide is approximately −190° C.

EXAMPLE II

The nitrogen-impregnated carbon dioxide nuggets from Example I is cut into rectangular blocks approximately one inch thick. As shown in the FIGURE, a styrofoam cryoshipping container 10 has sides 15 and a top 20. The nitrogen-impregnated carbon dioxide nuggets 25 are packed on the bottom and the sides of the container 15. Nitrogen-impregnated carbon dioxide nuggets 30 also fill the top opening 35 of container 10.

For use of the present invention, a frozen sample (not shown) is lowered into the opening 35 of container 10. The nitrogen-impregnated carbon dioxide nuggets 30 are then packed over the sample. The top 20 is then placed on the top of container 10. The nuggets are loosely packed in the container, although shown agglomerated for illustrative purposes in the FIGURE.

EXAMPLE III

A heart valve that has been previously frozen and cooled to −190° C. is placed in the container described in Example II. A supply of nitrogen-impregnated carbon dioxide nuggets is then placed above the frozen heart valve so that the heart valve is now entirely surrounded by nitrogen-impregnated carbon dioxide nuggets. A styrofoam cover is placed on the container.

The temperature of the heart valve is monitored every hour. The temperature of the frozen heart valve is found to be maintained at a temperature below −150° C. for more than eight hours. After thawing, the heart valve is found to be greater than ninety percent viable as determined by incorporation of radioactive amino acids into protein, a technique that is well known to those skilled in the art.

It should be understood, of course, that the foregoing relates only to a preferred embodiment of the present invention and that numerous modifications or alterations may be made therein without departing from the spirit and scope of the invention as set forth in the appended claims.

I claim:

1. A solid freezing agent for maintaining a sample at supercold temperatures comprising solid carbon dioxide impregnated with liquid nitrogen to form a mixture of solid carbon dioxide and liquid nitrogen, wherein the solid mixture sublimes without passing through a liquid phase as the mixture warms up.

2. A container for storing and shipping a sample at supercold temperatures comprising:

a. a solid freezing agent comprising solid carbon dioxide impregnated with liquid nitrogen; and b. a container constructed of an insulating material and lined on the bottom, sides and top with said solid freezing agent, wherein the solid mixture sublimes without passing through a liquid phase as the mixture warms up.

3. The container of claim 2 wherein said container is constructed of styrofoam.

4. A method for storing and shipping a sample, comprising the steps of:

a. preparing a solid freezing agent by impregnating solid carbon dioxide with liquid nitrogen to form a mixture of solid carbon dioxide and liquid nitrogen;

b. lining a container with said solid freezing agent; and c. placing the sample into said container in such a way that the sample is surrounded on all sides by said solid freezing agent, wherein the solid mixture sublimes without passing through a liquid phase as the mixture warms up.

* * * * *